US005918545A

United States Patent [19]

Pym

[11] Patent Number: 5,918,545

[45] Date of Patent: Jul. 6, 1999

[54] METHOD AND APPARATUS FOR CLEANING FLEXOGRAPHIC PRINTING PLATES

[75] Inventor: Malcolm J. Pym, Exmouth, United Kingdom

[73] Assignee: Oxy-Dry Corporation, Itasca, Ill.

[21] Appl. No.: 08/659,862

[22] Filed: Jun. 7, 1996

[51] Int. Cl.[6] ..... B41F 35/02

[52] U.S. Cl. ..... 101/424; 101/424.1; 101/425

[58] Field of Search ..... 101/425, 424, 101/423, 424.1

[56] References Cited

U.S. PATENT DOCUMENTS

| | | | |
|---|---|---|---|
| 1,703,015 | 2/1929 | Ratignier | 101/425 |
| 4,015,307 | 4/1977 | Kossak | 101/425 |
| 4,090,445 | 5/1978 | Sassi | 101/425 |
| 4,135,448 | 1/1979 | Moestue | 101/425 |
| 4,340,893 | 7/1982 | Ort | 101/424.1 |
| 4,408,907 | 10/1983 | Bernardis | 400/124.11 |
| 5,010,819 | 4/1991 | Uribe et al. | 101/425 |
| 5,277,111 | 1/1994 | Uribe et al. | 101/425 |
| 5,542,352 | 8/1996 | Blackman et al. | 101/423 |
| 5,644,986 | 7/1997 | Gydesen | 101/424 |

*Primary Examiner*—Edgar S. Burr
*Assistant Examiner*—Leslie Grohusky
*Attorney, Agent, or Firm*—Leydig, Voit & Mayer, Ltd.

[57] ABSTRACT

An apparatus and method for cleaning flexographic printing plates which are mounted on a printing cylinder of a flexographic printing press, whereby the printing plates are scrubbed to remove ink, foreign matter and residue resulting from the flexographic printing press, followed by a rinsing of the residue from the printing plates, with the centralized collection of such residue for proper disposal, and the drying of the printing plates by directing pressurized air onto the printing plate to remove excess moisture without the need to remove the printing plates from the printing cylinder.

18 Claims, 6 Drawing Sheets

METHOD AND APPARATUS FOR CLEANING FLEXOGRAPHIC PRINTING PLATES

FIELD OF THE INVENTION

The present invention relates generally to flexographic printing presses and more particularly to methods and devices for cleaning flexographic printing plates.

BACKGROUND OF THE INVENTION

During the operation of flexographic printing presses, the flexographic printing plate on the plate cylinder tends to accumulate foreign matter, such as dried ink or ink build-up, paper, lint, clay, dirt and the like which must be removed in order to maintain quality printing. As a result, during an extended printing run, the flexographic plates must be either cleaned or replaced.

Flexographic printing plate cleaning has traditionally been a time-consuming, labor-intensive and expensive process. The presses must be completely stopped to permit manual access to the printing plates for plate cleaning. In the case of multiple color printing, i.e., wherein each color is printed by an individual printing unit, with the multiple, individual printing units closely aligned with each other, the individual printing units must be physically separated from each other to permit manual access to the flexographic printing plates mounted on the printing cylinders in order to clean the printing plates.

Typically, the flexographic printing plates are then cleaned by hand. In certain instances, the printing plates are cleaned while still mounted on the printing cylinder. In other instances, the printing plates are completely removed from the printing cylinder and cleaned separately. In either case, the cleaning process involves physically scrubbing the printing plates by hand with a mixture of water and detergent (in the situation wherein water-based inks are being used) or scrubbed with a solvent (in the situation wherein solvent-based inks are being used). In an extremely time-consuming process, during which time the presses remain stopped, this scrubbing is generally done with a brush, by hand. The scrubbed plates are then manually rinsed, often with a hose, to remove loosened foreign matter, along with excess detergent and ink residue. The free run-off of the rinsed material, however, is often uncontrolled and haphazard.

The rinsed plates are then hand-dried with a towel to remove excess moisture. However, such hand drying often leaves moisture in the crevices of the printing plates which negatively impact subsequent printing quality until the printing plates are completely dried through use.

The cleaned printing plates are then remounted on the printing cylinders, the multiple printing units are realigned, the printing presses are restarted and printing resumes. Problems with hand-cleaning of flexographic printing plates have resulted in incomplete or uneven scrubbing, incomplete or uneven drying, uncontrolled residue run-off, and excessive press down-time during the cleaning process.

In an alternative to the hand-cleaning of flexographic printing plates, the presses are stopped, multiple printing units are separated to be manually accessible and the dirty flexographic printing plates are removed from the press cylinders and replaced with new, clean plates. The dirty printing plates are then typically discarded. The process of replacing dirty, but unworn or undamaged printing plates is expensive and requires the repeated utilization of plate-manufacturing equipment and personnel.

In those instances wherein the printing job is extensive, dirty printing plates may need to be removed and either cleaned or replaced several times during the run of the job, thereby further increasing press down-time and added expense.

OBJECTS AND SUMMARY OF THE INVENTION

It is therefore a primary objective of the present invention to provide devices and methods that enable the automatic cleaning of flexographic printing plates which remain mounted on the printing cylinder that are adapted for more economical and efficient operation.

It is an object of the present invention to provide a device for the automatic cleaning of flexographic printing plates which remain mounted on the printing cylinder that eliminates the need for manual scrubbing and drying of the printing plates.

Another object of the present invention is to provide a device for the automatic cleaning of flexographic printing plates which remain mounted on the printing cylinder that eliminates the need to remove printing plates from printing cylinders in order to clean the printing plates.

It is a further object of the present invention to provide a uniform scrubbing, rinsing and drying mechanism for cleaning flexographic printing plates which is mounted on the individual printing unit in order to preclude the need for manual separation of multiple printing units during the cleaning process.

A related object of the present invention is to provide a device for the automatic cleaning of flexographic printing plates which includes a directed drying system to uniformly remove all excess moisture from the cleaned flexographic printing plates without the need to manually dry the printing plates.

Yet another object of the present invention is to provide for the control of run-off washing and rinsing residue during and following the plate cleaning process for centralized collection and proper disposal.

An additional objective of the present invention is to provide methods for the automatic cleaning of flexographic printing plates that remain mounted on the printing cylinder which provide for the scrubbing, rinsing, and drying of flexographic printing plates rapidly, with greatly reduced press down-time.

A related object of the present invention is to provide methods for the repeated automatic cleanings of flexographic printing plates during the course an extended printing run.

The present invention provides devices and methods for the efficient, automatic, and uniform scrubbing, rinsing and drying of flexographic printing plates without the need for manual cleaning or for the need to remove dirty printing plates from the printing cylinder. The present invention thus precludes the need to physically separate multiple printing units for cleaning. The device and method of the present invention is a vast improvement over manual cleaning and provides increased cost savings in press down-time by minimizing the time needed to clean the printing plates. The present invention maximizes the overall printing quality through the use of clean printing plates and minimizes the need to replace dirty printing plates.

The automatic cleaning device of the present invention is mounted on a flexographic printing press and is engageable to cooperate with the flexographic printing plate positioned on the printing cylinder of the press to clean the printing plate. The flexographic printing plate cleaning device is comprised of a scrub unit which, by means of a rotating brush, in conjunction with the disbursement of detergent and water or a cleaning fluid mixture, scrubs the printing plate clean of foreign matter and rinses the plate with the disbursement of water or a cleaning solvent, recovering the washing and rinsing residue for proper disposal. The scrub unit is adapted for use with flexographic printing presses from a system used in the cleaning systems for cleaning blankets mounted on blanket cylinders used in off-set printing systems, as more specifically disclosed in U.S. Pat. No. 5,277,111 to Uribe et al., assigned to the same assignee as the present invention.

In the flexographic plate cleaning system of the present invention, a drying unit functions in conjunction with the scrub unit and dries the cleaned printing plate by providing a pressurized stream of directed air onto the surface of the printing plate, thus eliminating the need for manual drying.

Another aspect of the present invention is a method for cleaning flexographic printing plates. The method involves the automatic application to a flexographic printing plate mounted on a printing cylinder of a cleaning solution in conjunction with scrubbing, rinsing and blow drying operations to provide clean, dry flexographic printing plates in a reduced time, without the need for manual operations in a cleaning process. Such a method permits multiple cleanings of flexographic printing plates during extended printing runs thereby reducing press down time and maintaining print quality throughout the run.

These and other objects and advantages of the present invention, as well as additional inventive features, will be apparent from the description of the invention provided herein.

Figure 1:
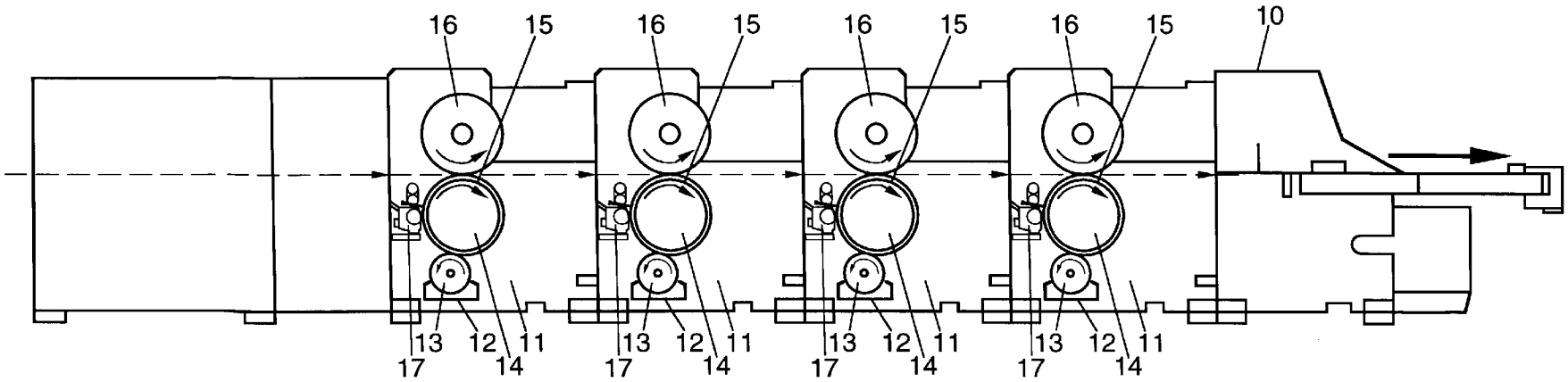
FIG. 1 is a diagrammatic side plan view of a flexographic printing line with printing plates mounted on the printing cylinders, illustrating the flow of substrate, e.g. paper, through multiple, aligned flexographic printing units, embodying the present invention mounted in conjunction with the plate roller of each printing unit.

While the invention is susceptible of various modifications and alternative constructions, certain illustrated embodiments thereof have been shown in the drawings and will be described below in detail. It should be understood, however, that there is no intention to limit the invention to the specific forms disclosed, but on the contrary, the intention is to cover all modifications, alternative constructions and equivalents falling within the spirit and scope of the intention.

DESCRIPTION OF THE PREFERRED EMBODIMENTS

The invention may best be understood with reference to the accompanying drawings wherein an illustrative embodiment is shown and in the following detailed description of the preferred embodiment. While the flexographic plate cleaning apparatus and methods of use can be used in conjunction with flexographic printing presses using solvent-based inks, the preferred embodiment is described with the view toward flexographic printing presses using water-based inks.

Referring generally to FIG. 1 of the drawings, there is shown an illustrative flexographic printing line 10 consisting of multiple flexographic printing units 11 for the printing of multiple colors. In FIG. 1, four printing units 11 which print one color each are shown, each closely aligned with the next for the continuous flow of paper through the printing line 10. Each printing unit 11 consists of an ink supply 12, a rotating ink cylinder 13, a plate cylinder 14, with a flexographic printing plate 15 mounted thereon, and an impression cylinder 16. Positioned on each print unit 11, in cooperative relation with each plate cylinder 14, is the flexographic plate cleaning apparatus 17 in accordance with the present invention.

In operation, paper or a suitable printing substrate moves through the flexographic printing line in the direction indicated in FIG. 1. Ink in the ink supply 12 is picked up by the rotating ink cylinder 13 and applied to flexographic printing plate 15. Flexographic printing occurs as paper moving between the plate cylinder 14 and the impression cylinder 16 creates an ink impression on the paper. During this printing process, flexographic printing plate 15 can accumulate foreign matter, such as dried ink or ink build-up, paper, lint, clay, dirt and the like which must be removed in order to maintain quality printing. This removal is accomplished by the flexographic plate cleaning apparatus 17 of the present invention.

Figure 2:
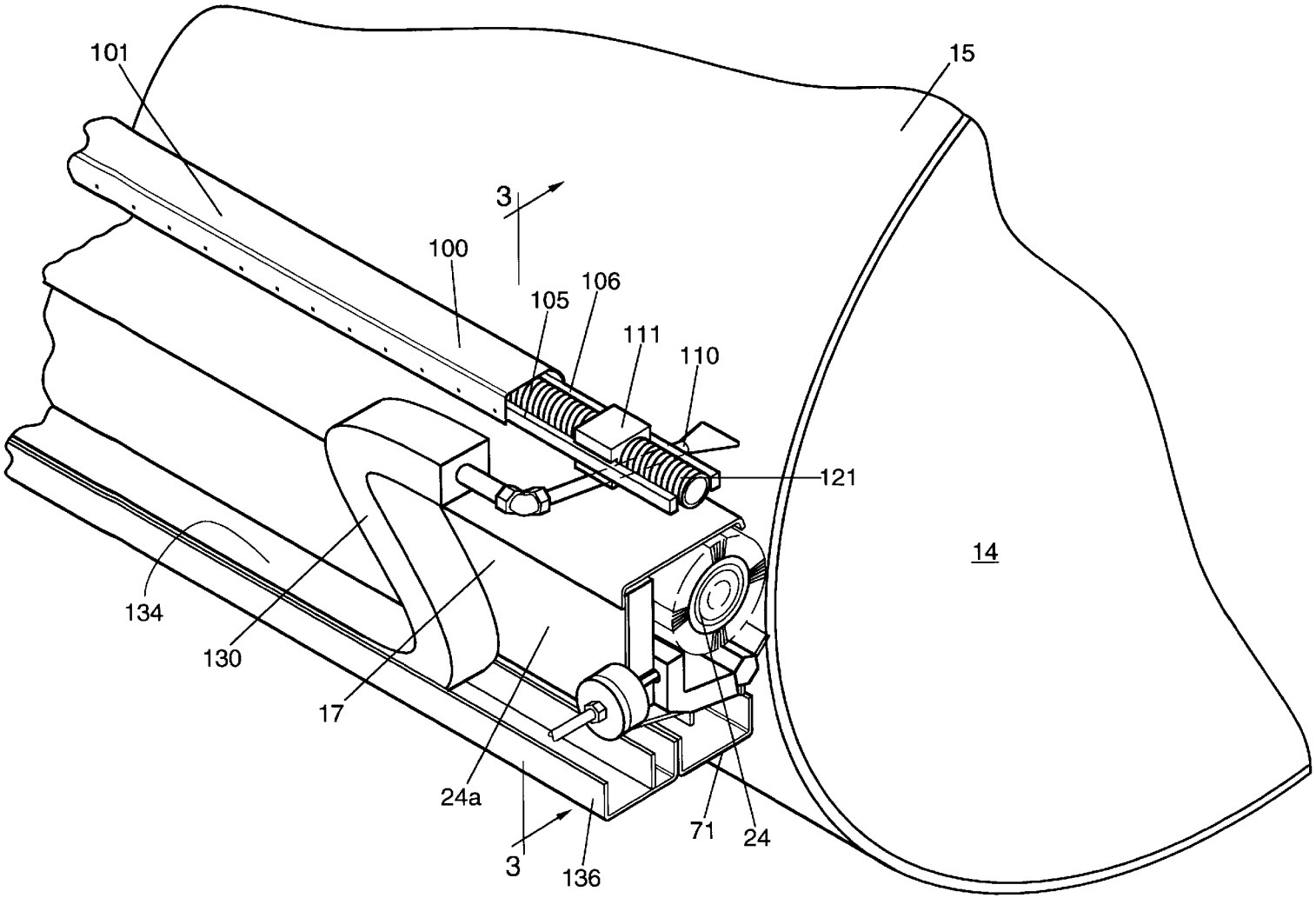
FIG. 2 is a perspective section of a single flexographic printing plate roller with the present invention mounted thereon taken in the plane of line 2—2 in FIG. 4.
Figure 4:
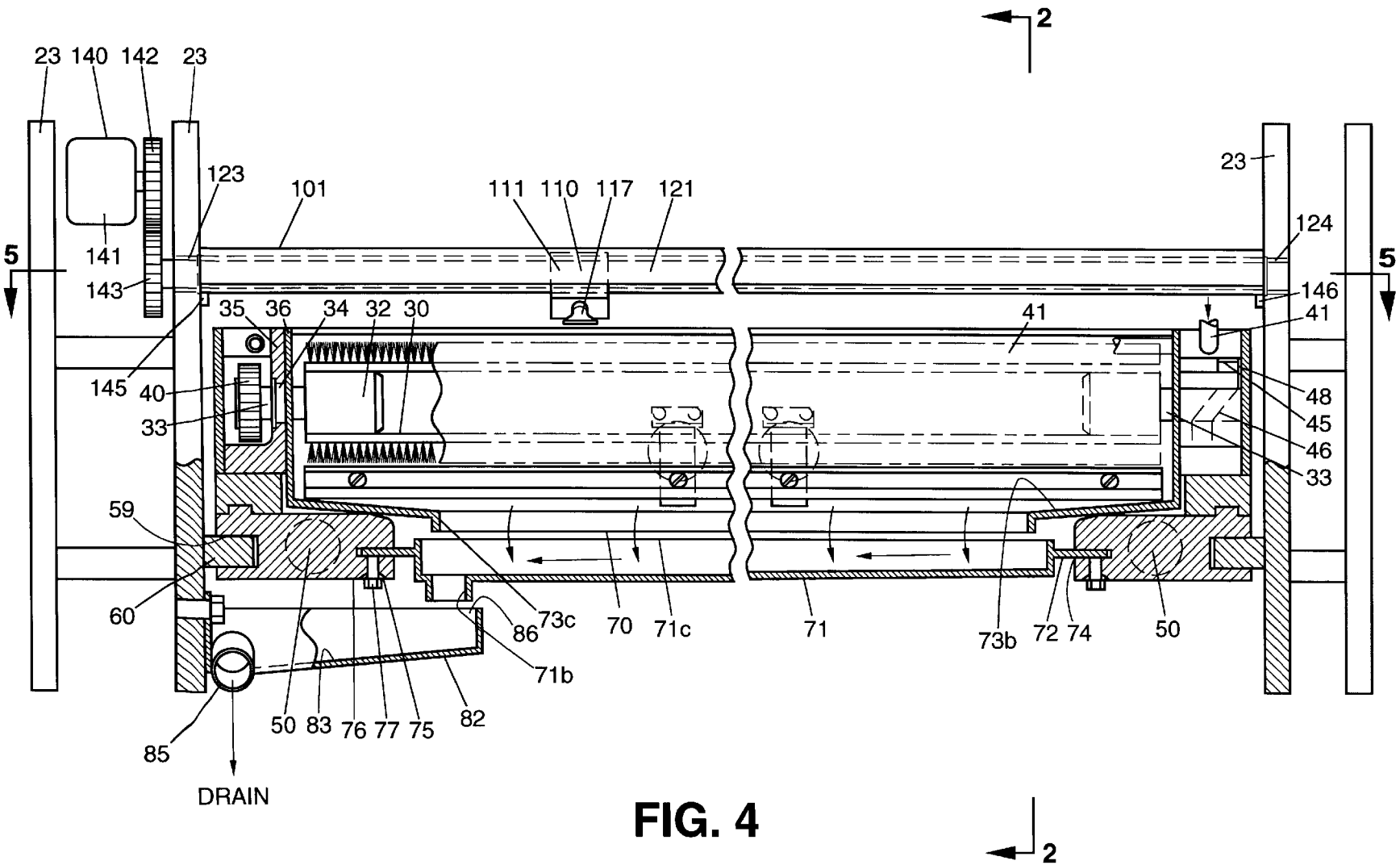
FIG. 4 is a front end view of the device of the present invention, in partial section, taken in the plane of line 4—4 in FIG. 3.

FIG. 2 illustrates a single flexographic printing plate cleaning apparatus 17 mounted in cooperative relation with a single plate cylinder 14, having a flexographic printing plate 15 mounted thereon. Each flexographic plate cleaning apparatus 17 includes a scrub unit 24, a scrub unit housing **24*a* with drain tray 71 and a drying unit 100 with dryer cover 101, a sprayer assembly 110, a screw shaft assembly 121, a pressurized air supply assembly 130, and a dryer drive assembly 140 (FIG. 4**).

Figure 3:
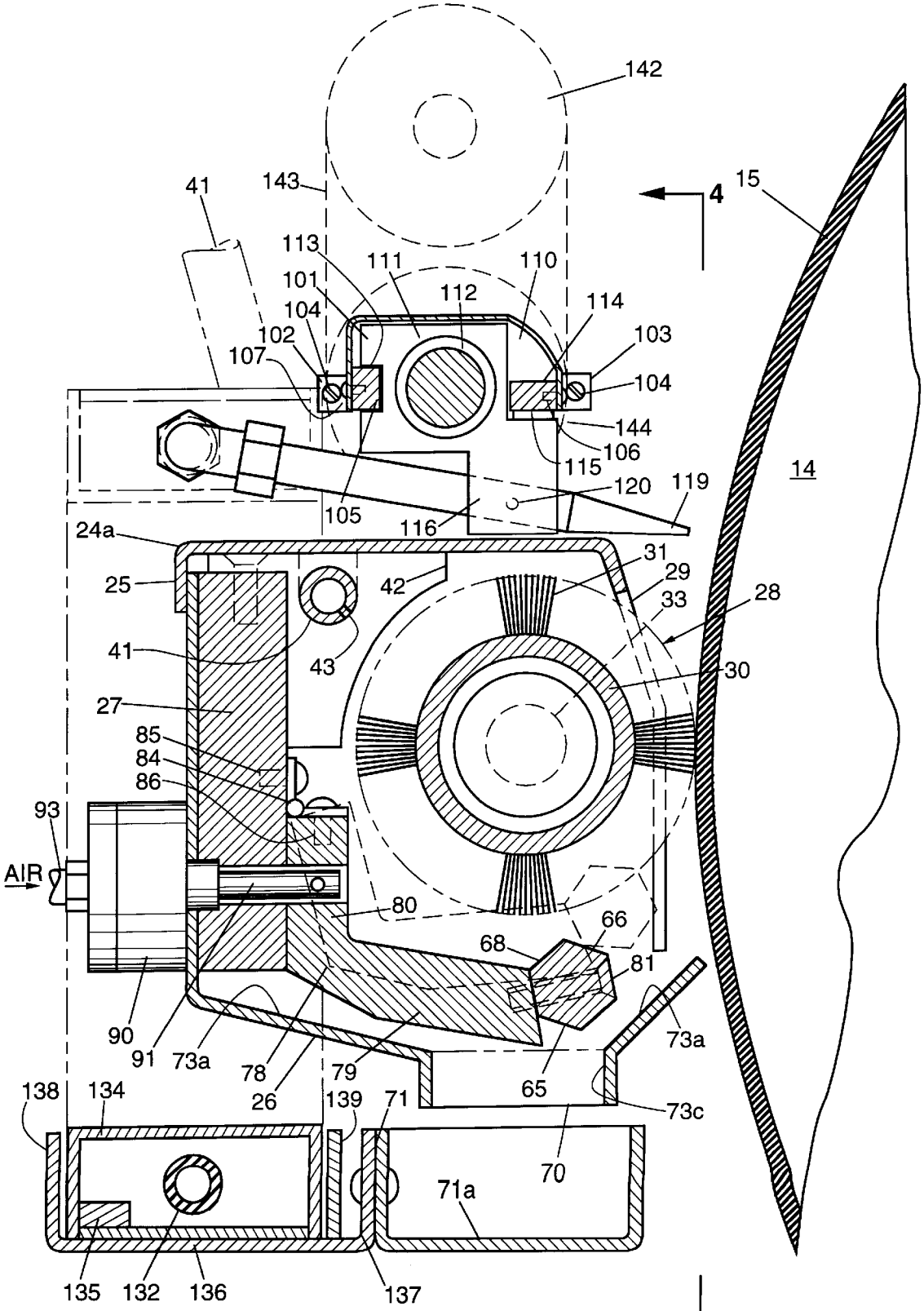
FIG. 3 is an enlarged side end view of the device of the present invention, in partial section, taken in the plane of line 3—3 in FIG. 2.

The scrub unit 24, as shown with more particularity in FIG. 3, includes a brush roller 28, having a scrub unit housing **24*a* consisting of upper and lower sections 25, 26 mutually secured to a rear support plate 27, along with a drain tray 71. Brush roller 28 is rotatably supported within the scrub unit housing 24*a*, and the upper and lower sections 25, 26 define a front opening 29 through which a forward portion of the brush roller 28** extends.

Figure 6:
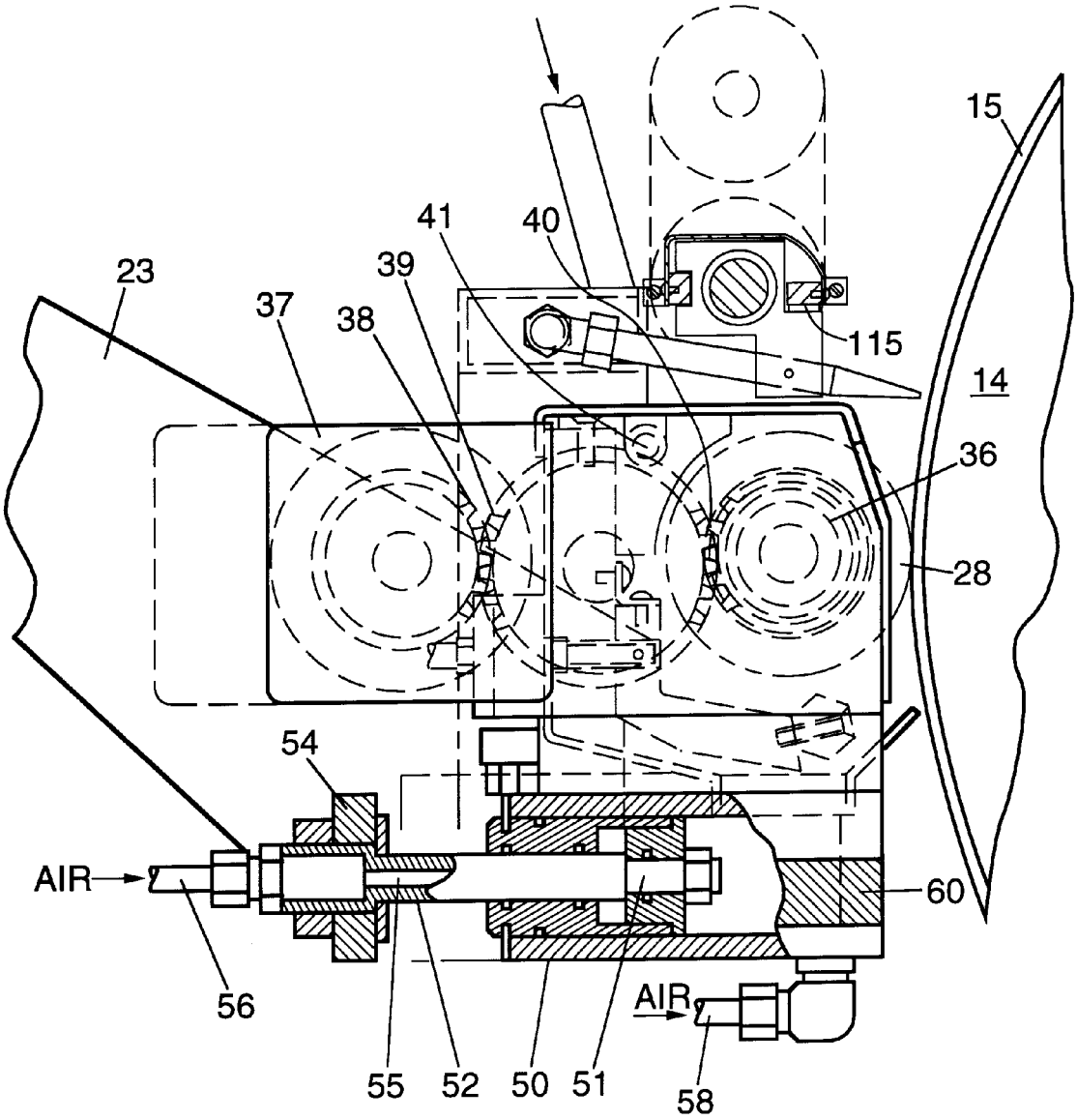
FIG. 6 is an enlarged side elevational view of the device of the present invention.

The brush roller 28 may be a commercially available type employed for cleaning blanket cylinders and plate cylinders typically used in offset printing. The brush roller 28 in this instance has a cylindrical core 30 with radially extending bristles 31. The bristles 31 must be sufficiently pliable so that the surface of the flexographic printing plate 15 being cleaned is not damaged, and yet sufficiently rigid so that, as will hereinafter be discussed, foreign matter may be removed from the bristles 31 by a flexing action of the bristles 31. For supporting the brush roller 28, cylindrical inserts 32 (FIG. 4) are provided in opposite ends of the cylindrical core 30, with the inserts each having an outwardly extending support shaft 33. To enhance servicing of the brush roller 28, it may be mounted in appropriate bearings 34 that are mounted in bearing block support plates 35 located at opposite ends of the housing which are formed with outwardly opening shaft receiving slots 36 (FIGS. 4 and 6). An appropriate removable retaining clamp is provided in the end of each slot 36 for maintaining the brush roller 28 in mounted position.

As shown in FIG. 6, for rotatably driving the brush roller 28, a motor 37, which in this case is an electric motor, is mounted rearwardly of the scrub unit 24. The electric motor 37, which may be of a known type, has a drive pinion 38 engageable with an intermediate gear 39 supported by the adjacent bearing block support plate 35 (FIG. 4), which in turn is engageable with a brush roller gear 40 mounted on the shaft 33 (FIG. 4) at the left hand side of the brush roller 28. The electric motor 37 drives the output pinion 38, which in turn drives the intermediate and brush roller gears 39, 40. The brush roller 28 is rotatable against the surface of the flexographic printing plate 15 being cleaned and at a rate such that effective cleaning is accomplished. The speed at which the brush roller 28 is rotated can be varied within wide limits, the principal criteria being that the speed is sufficiently high to provide effective cleaning in a minimum time.

The scrub unit 24 in this case also serves as a cleaning fluid applicator. For applying detergent and water to the brush roller during a cleaning operation, as shown in FIG. 3, water and detergent feed into a detergent and water distribution tube 41. Detergent and water distribution tube 41 runs substantially the length of the brush roller 28 and is disposed in the upper rear corner of the scrub unit housing, as viewed in FIG. 4. The distribution tube 41 is supported between a plurality of laterally spaced support brackets 42 mounted in the corner of the scrub unit 24 and is formed with a plurality of laterally spaced holes 43 along the length of distribution tube 41 adapted for directing detergent and water onto the length of the brush roller 28 on a side opposite the housing opening 29. The number and spacing of holes 43 in the distribution tube 41 should be sufficient to wet the entire length of the brush roller 28. The water and detergent mixture is directed through the distribution tube 41 for application on the brush roller 28 and then on the flexographic printing plate 15 in order to be cleaned of foreign matter, ink, and other water soluble materials.

To enhance the scrubbing and cleaning action of the brush roller 28, means preferably are provided for causing the brush roller to oscillate as it is rotating. In the illustrated embodiment, one of the brush roller shafts 33 has an outwardly extending cam follower 45 (FIG. 4). Cam plates 46 mounted on the brush unit housing define an annular cam groove 48 with a predetermined cam profile within which the cam follower 45 is disposed. Upon rotation of the brush roller 28 by its drive assembly, the cam follower 45 rides on the cam profile causing the brush roller to simultaneously reciprocate in an oscillatory manner. As is known in the art, as shown in FIG. 6, the drive pinion 38 for the drive motor 37 has sufficient width to accommodate such oscillating movement of the brush roller and its drive gears 39, 40.

For moving the scrub unit 24 within the scrub unit housing 24*a* between an operative position with the brush roller 28 in driving engagement with the flexographic printing plate 15 (FIG. 6) and a retracted or inoperative position with the brush roller 28 removed from the flexographic printing plate 15, a pair of air cylinders 50 are mounted on the underside of the scrub unit 24 at opposite ends thereof (FIGS. 4 and 6). Each air cylinder 50 has a piston 51 with a rearwardly extending follower rod 52 affixed to extended guides 60 of the frame plates 23 (FIG. 4) of the press by respective brackets 54. Each follower rod 52 in this case is formed with an internal passage 55 that is coupled to a pressurized air supply line 56 and communicates with the interior of the cylinder 50 on one side of the piston 51. Introduction of pressurized air through the line 56, as will be described below, causes the housing of the cylinder 50 and the scrub unit 24 connected thereto to move from its operative position (FIGS. 3 and 5) to the retracted position, while the rod 52 remains affixed to the extended guides 60. Introduction of pressurized air through a line 58 in communication with the opposite side of the piston 51 causes return movement of the cylinder 50 and scrub unit 24 from the inoperative position to the operative position with the brush roller 28 engaging the flexographic printing plate 15. For guiding movement of the scrub unit 24 between its operative and retracted positions, the housings of the cylinders 50 are formed with respective outwardly extending guideways 59, which ride on the inwardly extending guides 60 affixed to the frame plates 23 of the printing press (FIG. 4).

As seen in FIG. 3, the scrub unit 24 includes a brush roller flicker bar 65 that is adapted for relative movement with respect to the brush roller 28 such that the flicker bar 65 and brush roller 28 may be selectively brought into and out of engagement with each other for enabling removal of debris from the bristles 31 of the brush roller 28 by the flicker bar 65 while the scrub unit 24 is removed from the flexographic printing plate 15 and for enabling operation of the brush roller 28 against the printing plate 15 while the flicker bar 65 is removed from the brush roller 28.

To this end, for removing foreign matter and cleaning fluid from the brush roller 28, a flicker bar 65 is provided which desirably extends the length of the brush roller 28 and is adapted for engaging the underside of the brush roller 28, (as shown in phantom in FIG. 3). The flicker bar 65 has a first substantially flat surface 66 that is engageable with the underside of the brush roller 28 in inclined relation to the bristles 31 of the brush roller 28 that are brought into contact with the flicker bar 65 such that the individual bristles 31 are caused to be sequentially and progressively bent as they pass over the flicker bar 65 and then allowed to quickly return to their normal positions so as to effect removal of the cleaning fluid and foreign matter from the brush roller 28.

To permit such quick return movement of the bristles 31, the flicker bar 65 in this instance has a second inclined surface 68 rearwardly of the first surface 66, with the surfaces 66, 68 forming a generally pointed upper portion of the flicker bar 65. By virtue of the direction of rotary movement of the brush roller 28 and the position of the flicker bar 65 on the underside thereof, it can be seen that detergent and water and foreign matter dislodged from the brush roller 28 as the bristles 31 pass over the flicker bar 65 are deflected downwardly and in a direction away from the front opening 29 of the scrub unit 24.

For supporting the flicker bar 65 for movement between a first position in which the flicker bar is in engagement with the brush roller 28 (shown in phantom in FIG. 3) and a second position removed from the brush roller 28 (shown in solid lines in FIG. 3), a plurality of L-shaped arms 78 are provided. Each L-shaped arm has a first generally horizontal leg 79 supporting the flicker bar 65 at an outer end thereof by bolts 81 and a second upstanding, generally vertical leg 80 pivotally secured to the housing of the scrub unit 24 by hinge plates 84. The hinge plates 84 each have one leg secured to the support plate 27 of the housing by fastening screws 85 and a second leg secured by fastening screws 86 to the end of the upstanding leg 80 of the flicker bar support arm 78.

For pivoting the flicker bar support arms 78 and the flicker bar 65 carried thereby between the first and second positions, a plurality of air cylinders 90 are mounted on the rear of the scrub unit 24 and each has a respective cylinder rod 91 extending forwardly through the housing of the scrub unit 24 and pivotally coupled to one of the flicker bar support arms 78. It can be seen that upon actuation of the air cylinders 90 through communication of pressurized air to an inlet line 93, as will be described below, the rods 91 are extended to pivot the support arms 78 outwardly with respect to the scrub unit support plate 27, raising the flicker bar 65 into interacting relation with the underside of the brush roller 28. Deactuation of the air cylinders 90 permits retraction of the cylinder rods 91 and return of the upstanding legs 80 of the support arm 78 to a position immediately adjacent the support plates 27 defining the rear wall of the scrub unit 24, which lowers the flicker bar 65 to a position out of engagement with the brush roller 28 (FIG. 3).

For channeling detergent, water and foreign matter removed from the brush roller 28 by the flicker bar 65 and directing such materials away from the scrub unit 24, the lower housing section 26 of the scrub unit 24 has a trough-like form with an elongated, bottom discharge opening 70 extending substantially the length of the brush roller 28. In the illustrated embodiment, the discharge opening 70 has an elongated rectangular configuration defined by a pair of downwardly tapered side walls 73*a* (FIG. 3), which direct detergent, water and foreign matter to a location immediately below the brush roller 28 and a pair of downwardly tapered end walls 73*b* (FIG. 4) that extend under the respective opposite ends of the brush roller 28 relatively short distances so as to channel detergent, water and foreign matter inwardly over the cylinders 50 to the discharge opening 70. The tapered side and end walls 73*a*, 73*b* (FIG. 4) each terminate in a depending vertical lip 73*c*. Hence, detergent, water and foreign matter being ejected from the brush roller 28 by the flicker bar 65 are caused to be directed to and through the relatively large discharge opening 70 immediately below the brush roller.

For receiving and channeling detergent, water and foreign matter discharging from the housing discharge opening 70, as seen in FIG. 4, a drain tray 71 is removably supported in vertically spaced relation immediately below the discharge opening 70. The drain tray 71 in this instance has a pair of outwardly extending arms 72 at opposite ends thereof that are received in respective inwardly opening slots 74 in the housings of the air cylinders 50. Releasable retaining means are provided for securing the arms 72 in mounted position. The retaining means in this case include spring loaded retainers which each comprise a screw 75 threaded in engagement in an aperture extending from the underside of the housing of the respective cylinder 50 into the arm receiving slot 74. The upper end of the screw 75 is recessed for housing a spring biased detent ball 76, which will releasably engage a detent or aperture formed in the underside of the arm 72 upon positioning of the arms 72 into the slots 74. A retaining nut 77 secures the screw 75 in mounted position.

The drain tray 71 has an open top rectangular configuration that completely underlies the housing discharge opening 70. The drain tray 71 has a bottom panel 71*a* (FIG. 3) tapered downwardly to the left, as viewed in FIG. 4, for directing solids and fluids toward a drain opening 71*b* adjacent the end of the tray. The drain tray 71 preferably is configured such that the upper peripheral edge 71*c* thereof is disposed in spaced relation below the lower peripheral edge of the discharge opening lip 73*c*. Such clearance between the drain tray 71 and the discharge opening lip 73*c* permits relatively easy removal and replacement of the drain tray 71, and in the unlikely event that the drain 71*b* should become clogged, the accumulation of detergent, water and foreign matter within the drain tray 71 can rise only to the upper level of the drain tray, thereby preventing a condition in which the underside of the brush roller 28 might contact accumulated detergent and water and cause excessive amount of detergent and water to be applied to the moving web.

The drain tray 71 in the illustrated embodiment discharges into a drain trough 82 supported in cantilever fashion from the side frame plate 23 on the left hand side of the unit, as viewed in FIG. 4. The drain trough 82 has a bottom wall 83 that is tapered downwardly to a drain 85 and is coupled to a discharge line for directing the detergent, water and foreign matter for proper disposal. The upper peripheral edge 86 of the drain trough 82 again is disposed in vertically spaced relation below the lower peripheral edge of the drain 71*b* so as to prevent interference with removal and replacement of the drain tray 71.

Figure 5:
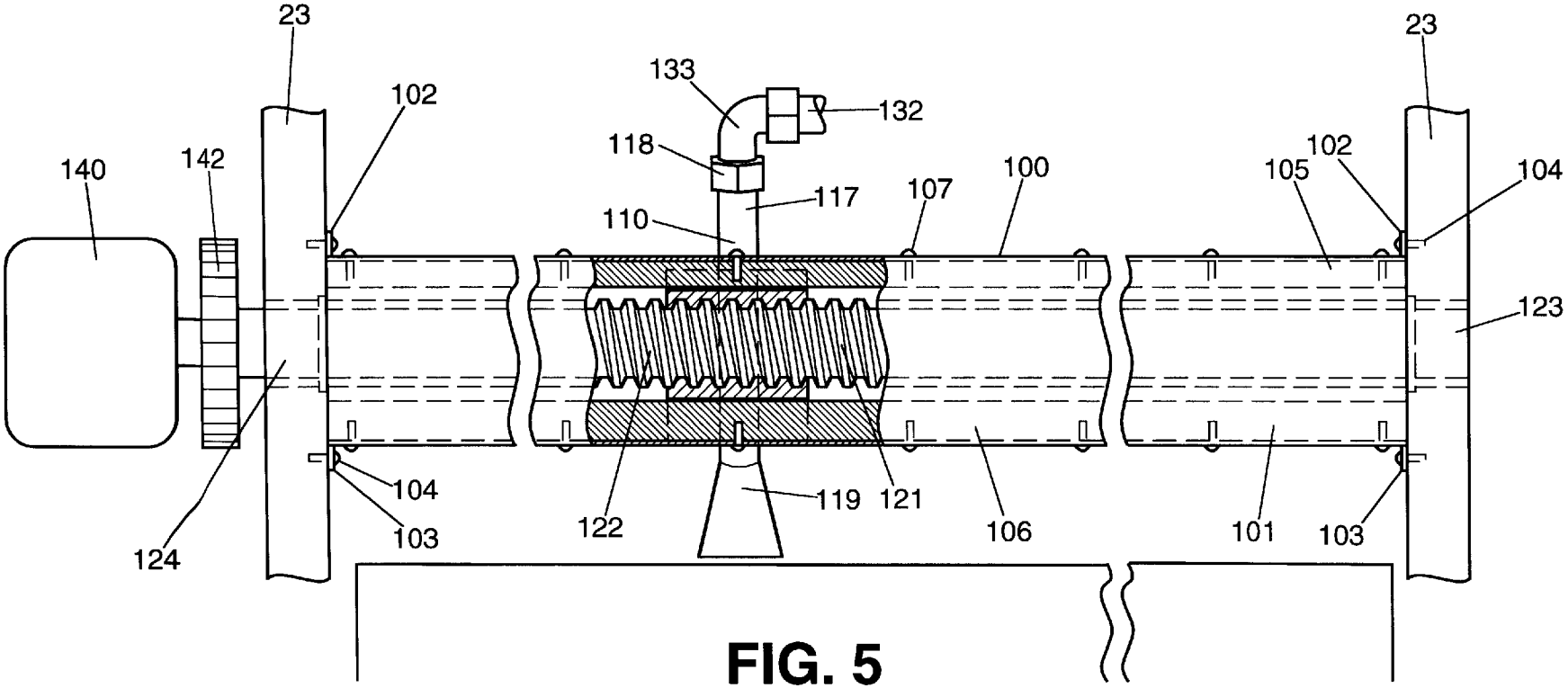
FIG. 5 is an enlarged vertical section of the drying unit of the device of the present invention, taken in the plane of line 5—5 in FIG. 4.

In accordance with an important aspect of the invention, each flexographic printing plate cleaning apparatus 17 includes a drying unit 100 which provides a directed, pressurized air stream in a sweeping motion across the length of the flexographic printing plate 15 to remove excess moisture and to dry the plate. As seen in FIG. 5, the drying unit 100 is mounted between respective side frame plates 23 in a location such that the application of drying air occurs in sequence following the washing and rinsing of the flexographic printing plate 15 by the scrub unit 24 as the plate cylinder 14 rotates (FIG. 1). Mounting flanges, 102, 103 are provided on each end of the dryer cover 101, which is attached to the side frame plates 23 by mounting screws 104.

As shown in FIG. 2, the dryer unit 100 includes a sprayer assembly 110, a screw shaft assembly 121, a pressurized air supply assembly 130, and a dryer drive assembly 140 (FIG. 5). Screw shaft assembly 121 is covered by dryer cover 101 which protects the screw shaft assembly from exposure to dirt, debris, or the like which might tend to obstruct or hinder the movement of sprayer assembly 110. The dryer cover 101 also serves as a travel guide for the back and forth movement of the sprayer assembly 110 during drying operations. As shown in FIG. 2 and more clearly depicted in FIG. 3, along the inner lateral surface of dryer cover 101, and running the entire length of dryer cover 101, are mounted a near guide key 105 and a far guide key 106 using mounting screws 107 (FIG. 5).

Sprayer assembly 110, as shown in FIG. 3, includes a traversing nozzle mount 111 which includes a threaded, central traversing bore 112 which is co-axially and threadedly mounted on threaded screw bar 122 (FIG. 5), a near keyway 113 and a far keyway 114. Mounted on the base surface of the far keyway 114 on each end of traversing nozzle mount 111 are switching magnets 115. Spray tube mounting bore 116 is perpendicular to and down set from central traversing bore 112 and is angled in such a way as to be generally perpendicular to plate cylinder 14. As seen in FIG. 5, adjustably inserted into mounting bore 116 is tubularly shaped spray tube 117, having at one end a threaded connection 118 for connecting with a pressurized air supply and, at the other end, a fan-shaped nozzle tip 119. As shown in FIG. 3, nozzle tip 119 is positioned within mounting bore 116 by adjusting set screw 120 so that nozzle tip 119 is approximately 6–10 millimeters from flexographic printing plate 15.

For supporting and traversing nozzle mount 111, screw shaft assembly 121 includes a threaded screw bar 122 which is rotatably mounted between side frame plates 23 in bushings 123, 124. Threadably interfaced with screw bar 122 is traversing nozzle mount 111, which is positioned in such a manner that near guide key 105 on the dryer cover 101 communicates with near keyway 113, and far guide key 106 on the dryer cover 101 communicates with far keyway 114. The interface between guide keys 105 and 106 and keyways 113 and 114 provide stability to nozzle mount 111 as it traverses back and forth. This interface precludes nozzle mount 111 from rotating as screw bar 122 rotates, so that the rotational motion of screw bar 122 is translated into lateral movement over the length of screw bar 122.

For providing pressurized air to dryer unit 100, pressurized air is provided from a pump (not shown) of a known type, into a pressurized air supply assembly 130 which includes air conduit 132 between the pump and the dryer unit 100. To preclude any uncontrolled movement of air conduit 132 during drying operations, as shown in FIG. 2, air conduit 132 is enclosed in linked, articulated caterpillar track 134, which restricts the lateral movement of air conduit 132 as the sprayer assembly 110 traverses back and forth in the drying process. As shown in FIGS. 2 and 3, additional control of the movement of air conduit 132 is provided by guide tray 136, which is connected to drain tray 71 on the scrub unit 24 by tray flange 137. Guide tray 136 provides vertical support for caterpillar track 134 and, with raised walls 138, 139, also provides lateral support. Since commercially available linked, articulated caterpillar track 134 is made of lightweight material, a weight 135 (FIG. 3) running inside substantially the length of the caterpillar track 134 provides further stability of movement to the air conduit 132. As shown in FIG. 5, pressurized air is provided through air conduit 132 to nozzle connector 133 which is connected to spray nozzle 117 by threaded connection 118.

For traversing nozzle mount 111 during drying operations, as shown in FIGS. 3 and 4, a dryer drive assembly 140 is provided with a motor 141, which in this case is an electric motor, that is mounted on the outward side of side frame plate 23. The electric motor 141, which may be of a known type, has a drive pinion 142 engageable by way of drive belt 143 with a screw bar gear 144 mounted on screw bar 122. Rotational motion from motor 141 is transmitted via drive pinion 142 and drive belt 143 to screw bar gear 144, which rotates screw bar 122.

For reversing the rotation of screw bar 122, thereby reversing the direction of movement of sprayer assembly 110 to provide a back and forth movement, as shown in FIG. 4, mounted on the inward side of side frame plates 23 are magnetically activated polarity switches, 145 and 146, which, when they come in contact with switching magnet 115 mounted on nozzle mount 111, reverses the rotational direction of motor 141, thereby reversing the rotation of screw bar 122, and reversing the direction of movement of sprayer assembly 110. In this manner, sprayer assembly 110 sweeps back and forth over the length of screw bar 122.

The electrical controls of the flexographic plate cleaning apparatus 17 are interfaced with the electrical controls of the printing press 10 and associated electrically powered devices, such that the cleaning process is electrically coordinated with the overall press operations. Such electrical controls, electrical connections and wiring are well known to those of ordinary skill in the art and are not the subjects of the present invention. Similarly, controls for the delivery of pressurized air to the air supply 130 of the dryer unit 100, for the delivery of pressurized air to air cylinders 50 for moving the brush assembly 24 between an operative position and an inoperative position as addressed above, and for the delivery of pressurized air to a plurality of air cylinders 90 in order to pivot the flicker bar support arms 78 between the first and second positions, also addressed above, are well known to those of ordinary skill in the art and are not the subjects of the present invention. Further, the control of the delivery of incoming detergent and water to scrub unit 24 is well-known in the art.

In the operation of the flexographic printing plate cleaning apparatus 17, the substrate (e.g., paper) flow through the press is stopped and the press speed in reduced from a normal press operation speed to a speed compatible with plate cleaning operations. As the plate cylinder 14 rotates with the flexographic printing plate 15 mounted thereon, the flexographic plate cleaning apparatus 17 of the present invention is engaged. The scrub unit 24 is brought in the operative position with the plate 15 (FIG. 3).

A scrub cycle is initiated whereby detergent is pumped into the scrub unit 24 through distribution tube 41 which runs substantially the full length of the brush 28, distributing detergent through holes 43 onto the brush. Brush 28, rotating and oscillating as addressed above, communicates with the flexographic printing plate 15 so that the bristles 31 of the brush transfer detergent to printing plate 15 and, through the action of the bristles, uniformity remove dried ink, ink build-up, paper, lint clay, dirt, and the like. Flicker bar 65 may be engaged, in the manner addressed above, to assist in the removal of ink, paper and the like from the bristles 31 of the brush 28. Foreign matter and excess detergent are directed downward from brush 28, through housing discharge opening 70, into drain tray 71, and along drain trough 82 for discharge to drain 85 for proper disposal.

Following the scrub cycle, a rinse cycle is initiated whereby water is pumped into the scrub unit 24 and through the distribution tube 41 to uniformly rinse the flexographic printing plate 15 clean of loosened foreign matter, excess detergent, ink, paper and the like through the rotating and oscillating action of brush 28 as the bristles 31 interface with the printing plate 15. Again, flicker bar 65 may be engaged to assist in the removal of ink, paper and the like from the bristles 31. Disposal of foreign matter, detergent and excess rinse water is handled in the same manner as during the scrub cycle. Scrub and rinse cycles may be repeated as necessary to ensure the complete cleaning of the flexographic printing plate 15.

A drying cycle is initiated whereby pressurized air is provided to sprayer assembly 110 through air conduit 132 to spray nozzle 117 which directs the pressurized air onto flexographic printing plate 15, thereby blowing all excess moisture from the crevices in plate 15 and uniformly drying the plate. The sprayer assembly 110 traverses back and forth over substantially the length of the plate 15, as the screw bar 122, which is driven by electric motor 141, rotates within the traversing bore 112 of the nozzle mount 111, where, with the use of keys 105, 106 and keyways 113, 114, translates the rotational motion of the screw bar 122 into lateral motion. As the sprayer assembly 110 reaches one end of the screw bar 122, switching magnet 115 activates polarity switches 145 or 146 thereby reversing the rotation of motor 141, which reverses the rotation of screw bar 122 and the direction of movement of sprayer assembly 110, sending the sprayer assembly 110 back and forth, until the printing plate 15 is dry. This flexographic plate cleaning process takes only a few minutes to complete and can be initiated at any time during the printing process to ensure clean printing plates.

I claim as my invention:

1. A printing press comprising a rotatable plate cylinder a flexographic printing plate having a printing surface defined by crevices formed therein removably mounted on said plate cylinder, a rotatable impression cylinder adjacent the plate cylinder, an ink supply for supplying printing ink to the printing plate, a drive for rotating said plate cylinder at a printing speed and at a reduced plate cleaning speed, a cleaning apparatus selectively operable for cleaning the printing plate of accumulated residues while mounted on said rotating plate cylinder, said cleaning apparatus including a liquid cleaning fluid applicator unit for applying liquid cleaning fluids to the printing plate to remove residues and clean the printing plate while said plate cylinder is rotated at said reduced plate cleaning speed, and a drying unit including a pressurized air source and at least one air directing nozzle operable for directing a pressurized air stream against said printing plate while said plate cylinder is rotatably driven at said reduced plate cleaning speed following cleaning by the liquid cleaning fluid applicator unit to forcefully blow liquids and remaining residues from said printing plate crevices and to dry the printing plate as the plate cylinder is rotated.

2. The printing press of claim 1 in which said liquid cleaning fluid applicator unit includes a scrub unit having a rotatable brush roller that is selectively moveable between a cleaning position in engagement with the printing plate and plate cylinder and a removed position, and a cleaning fluid supply for directing cleaning fluid onto the brush roller during a cleaning operation.

3. The printing press of claim 2 in which said cleaning fluid supply includes a cleaning fluid distribution tube extending substantially the length of said brush roller for directing laterally spaced flow streams of cleaning fluid onto said brush roller.

4. The printing press of claim 2 in which said cleaning fluid supply is selectively operable for directing liquid detergent cleaning fluid and rinse water onto the brush roller for cleaning and rinsing the printing plate during a cleaning operation.

5. The printing press of claim 2 in which said brush roller has a drive for both rotating the brush roller and oscillating the brush roller axially with respect to the printing plate and plate cylinder during a cleaning operation.

6. The printing plate of claim 2 in which said scrub unit includes a flicker bar engageable with said brush roller to facilitate removal of cleaning fluid and foreign matter from the brush roller, and said flicker bar being selectively moveable between an engaging position with said brush roller and a removed position in disengaged relation to the brush roller.

7. The printing press of claim 1 in which said air directing nozzle is disposed above said scrub unit.

8. The printing press of claim 1 in which said air directing nozzle is moveable axially with respect to the plate cylinder for directing a pressurized air stream in a sweeping motion along the length of the printing plate.

9. The printing press of claim 8 which said air directing nozzle is axially moveable relative to the brush roller.

10. The printing press of claim 9 in which said air directing nozzle is connected to a pressurized air source by a flexible conduit.

11. The printing press of claim 9 in which said air directing nozzle is connected to a fixed pressurized air source.

12. The printing press of claim 8 in which said air directing nozzle is supported by a mount having a threaded aperture, a drive screw disposed within said threaded aperture, and a drive motor for selectively rotating said drive screw to move said nozzle mount and air directed nozzle relative to said drive screw and plate cylinder.

13. The printing press of claim 12 including a scrub unit and a housing, and said air directing mount and scrub unit housing defining cooperating keys and keyways for guiding longitudinal movement of the air directing nozzle mount longitudinally with respect to said plate cylinder.

14. The printing press of claim 8 in which said air directing nozzle is moveable along substantially the entire length of said printing cylinder.

15. A method of cleaning a flexographic printing plate having printing surface defined by crevices therein mounted on a rotatable plate cylinder of a printing press that is rotatably driven at press speed during a printing operation comprising the steps of reducing the rotary spaced of the plate, cylinder to a plate cleaning speed less than press speed, scrubbing the printing plate with a rotatable brush and applying liquid fluid to the plate cylinder to remove ink, foreign matter and residue from the printing plate while the plate cylinder is rotating at said reduced speed, and drying the printing plate by directing a pressurized air stream onto the printing plate to blow excess moisture and remaining residue from the printing plate crevices and to dry the printing plate while the plate cylinder is rotating at said reduced speed.

16. The method of claim 15 including directing pressurized air onto to the printing plate from an air directing nozzle, and moving the air directed nozzle axially with respect to the plate cylinder and brush as the plate cylinder is rotated at said reduced speed to direct the pressurized air stream along substantially the entire length of the plate cylinder.

17. A printing press comprising a rotatable plate cylinder carrying a printing plate, a rotatable impression cylinder adjacent the plate cylinder, an ink supply for supplying printing ink to the printing plate, a cleaning apparatus selectively operable for cleaning the printing plate of accumulated residues without removing the printing plate from the plate cylinder, said cleaning apparatus having a housing and including a liquid cleaning fluid applicator unit for applying liquid cleaning fluids to the printing plate to remove residues and clean the printing plate as the plate cylinder is rotated, said liquid cleaning fluid applicator unit including a scrub unit having a rotatable brush roller that is selectively moveable between a cleaning position in engagement with the printing plate and a removed position, a cleaning fluid supply for directing cleaning fluid onto the brush roller during a cleaning operation, said cleaning apparatus further including a drying unit operable for drying the printing plate of liquids following cleaning by the liquid cleaning fluid applicator unit as the plate cylinder is rotated, said drying unit including a pressurized air supply and an air directing nozzle coupled to said pressurized air supply for directing pressurized air against the printing plate and plate cylinder as the plate cylinder is rotated following cleaning of the printing plate by the scrub unit, said air directing nozzle being supported by a mount having a threaded aperture, a drive screw disposed within said threaded aperture, a drive motor for selectively rotating said drive screw to move said nozzle mount and air directed nozzle relative to said drive screw and plate cylinder, and said housing and nozzle mount defining cooperating keys and keyways for guiding movement of the nozzle mount and air directing nozzle relative to the plate cylinder.

18. The printing press of claim 17 in which said motor is selectively operable for rotating said screw in one direction to move the nozzle mount in one direction with respect to said plate cylinder and for rotating the drive screw in an opposite direction to move the nozzle mount in a reverse direction, switches for controlling operation of the motor, and magnets mounted on the nozzle mount for actuating said switches.

* * * * *